United States Patent [19]

Zawadowsky

[11] 3,967,330

[45] July 6, 1976

[54] FOLDING BED

[75] Inventor: Bohdan Zawadowsky, Islington, Canada

[73] Assignee: Lawrence Peska Associates, Inc., New York, N.Y. ; a part interest

[22] Filed: May 21, 1975

[21] Appl. No.: 566,619

[52] U.S. Cl. ..... 5/114; 5/111

[51] Int. Cl.[2] ..... A45F 1/00

[58] Field of Search ..... 5/111, 112, 114, 174

[56] References Cited

UNITED STATES PATENTS

| | | | |
|---|---|---|---|
| 2,788,531 | 4/1957 | Dye et al. | 5/191 |
| 2,833,375 | 5/1958 | Lundelius | 5/111 X |
| 3,044,080 | 7/1962 | Hartwig | 5/111 |
| 3,108,291 | 10/1963 | Eason | 5/111 |
| 3,327,982 | 6/1967 | Kramer | 5/111 |

*Primary Examiner*—Casmir A. Nunberg

*Attorney, Agent, or Firm*—Joel Halpern

[57] ABSTRACT

A folding bed having a rectangular frame divided longitudinally into four equal sections and foldable to have each section lie flat against the next adjacent section. The two central sections are pivotable about a non-foldable leg and are foldable to lie against such leg. The two outer sections are supported in use by foldable legs while one of the outer sections is inclined to the plane of the frame when in its open position.

7 Claims, 6 Drawing Figures

FOLDING BED

BACKGROUND OF THE INVENTION

The present invention relates to a folding bed of the type which can be transported and compactly stored when not in use.

Beds are well known which may be folded and transported or stored when not in use. The construction of such beds seeks to achieve strength when in use and compactness and portability when folded for transport or storage. However, an optimum construction has yet to be achieved.

SUMMARY OF THE INVENTION

It is an object of the present invention to provide a folding bed which is simple and inexpensive to construct, and which is sturdy in use, easy to set up and collapse, and compact when folded for transportation or storage.

Other objects and advantages of the invention will become readily apparent from the following description of the invention.

According to the present invention there is provided a folding bed, comprising, a substantially rectangular frame adapted to carry body supporting means in the plane thereof and articulated longitudinally into two central sections and two end sections; at least one central leg having the two central sections of the frame pivotally attached and foldable downwardly to lie against said central leg; the two end sections of the frame being pivotally attached to their adjacent central sections and foldable upwardly to lie against said central sections; longitudinally spaced legs pivotally attached to each central section remote from and on the opposed longitudinal sides of said central leg and foldable upwardly to lie against said central sections; a further leg pivotally attached to one of the end sections remote from the leg of the adjacent central section and foldable upwardly to lie against said end section; and means for releasably securing the other of the end sections in a plane inclined to the plane of the frame.

BRIEF DESCRIPTION OF THE DRAWINGS

In order that the invention may be more fully understood it will now be described, by way of example, with reference to the accompanying drawings in which.

DETAILED DESCRIPTION OF THE INVENTION

Figure 1:
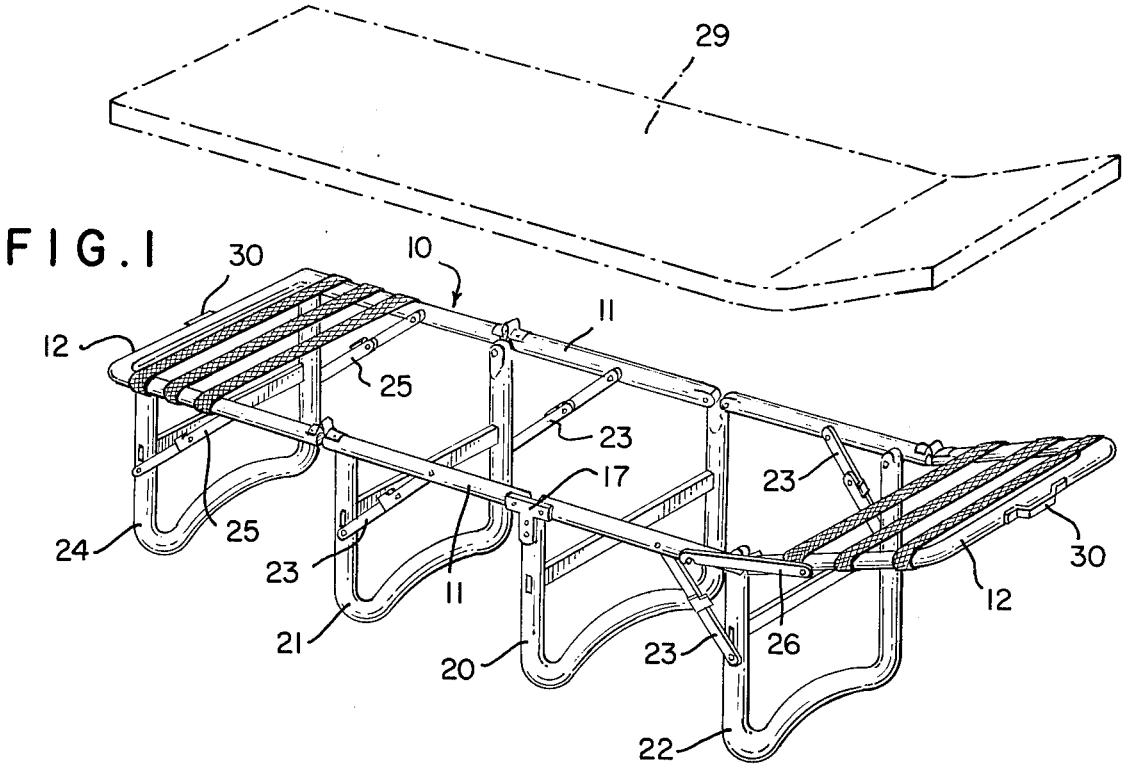
FIG. 1 is a view in perspective of a folding bed according to the invention, fully unfolded for use.
Figure 2:
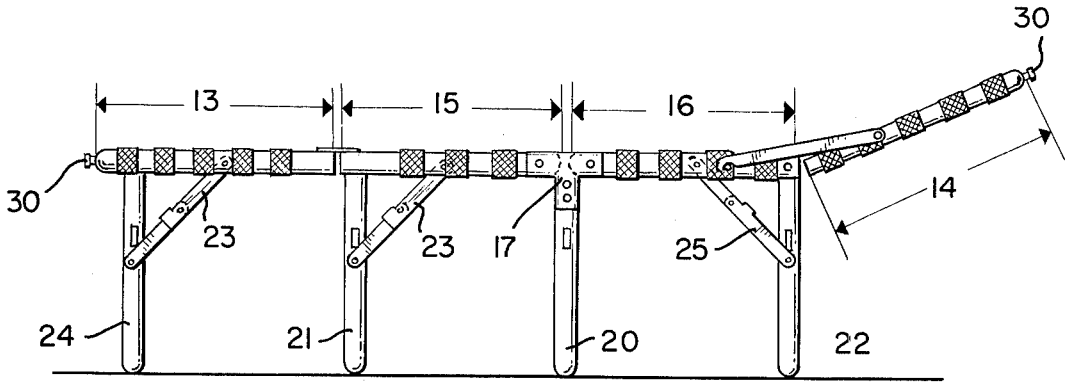
FIG. 2 is a side view in elevation of the bed shown in FIG. 1.

Referring to FIGS. 1 and 2 of the drawings there is shown a rectangular bed frame 10 having a pair of parallel side bars 11 and a pair of parallel end bars 12. Side bars 11 are divided to provide frame 10 with four interconnected sections of approximately equal dimensions, namely end sections 13, 14 and intermediate sections 15, 16. Intermediate sections 15 and 16 are pivotally connected, for downward movement, to the lateral arms of a pair of vertical T-plates 17 on the opposed sides of the frame while end sections 13 and 14 are connected with intermediate sections 15 and 16 respectively by a pair of generally U-shaped hinges 19 fixed to the upper faces of bars 11 for upward folding movement of the end sections.

The upper ends of a central leg 20 are fixed to the vertical stem of the respective T-plates 17, thus rendering such leg to be non-foldable. A leg 21 is pivotally connected on each of bars 11 at right angles to intermediate section 15 remote from T-plates 17 whereas a leg 22 is similarly connected to intermediate section 16 an equal distance from and on the other longitudinal side of leg 20. Each leg 21 and 22 is held in downward (open) position by a jack-knife brace 23 pivotable at its center and at each of its end to the respective leg and the intermediate section, whereby each such leg is foldable upwardly parallel to bar 11 in that particular frame section. End section 13 carries a leg 24 pivotable on the end section remote from hinges 19 and held in open, downward position by jack-knife braces 25 which are of the same construction as braces 23 and are foldable to allow leg 24 to be pivoted upwardly parallel to bars 11 of end section 13 of frame 10. When legs 21, 22 and 24 are folded upwardly against bars 11 of frame 10 they are spaced laterally from the bars to provide clearance for the accommodation of braces 23 and 25. Alternately, the sections may be angled and the legs and braces are receivable within the angles in known manner. Each of shown as including a base section connecting upstanding legs; however it will be understood that each of such legs may be formed as separate pairs of legs. In such instance each pair of legs may be suitably cross-braced.

Each bar 11 in end section 14 carries a latching bar 26 which is pivoted at one end adjacent that bar and is adapted, when the end section is pivoted outwardly about hinges 19 at a shallow angle from the plane frame 10, to engage a pin 27 fixed on bar 11 in intermediate section 16. End section 14 is thus held in a position inclined to the plane of frame 10 by latching bars 26 which engage pins 27 on the opposite sides of intermediate section 16.

Frame 10 may support a wire spring web (not shown) which supports a mattress 29 shown in phantom in FIG. 1. Of course, webbing could be replaced by any other suitable material such as a sheet of canvas attached to bars 11 and 12 of frame 10. End bars 12 of frame 10 carry gripping handles 30 on their outwardly facing surfaces.

When in use, the bed sits unfolded as shown in FIGS. 1 and 2 with legs 21, 22 and 24 opened downwardly from frame 10 and locked in open position by braces 23 and 25. Mattress 29 rests on web 28.

Figure 3:
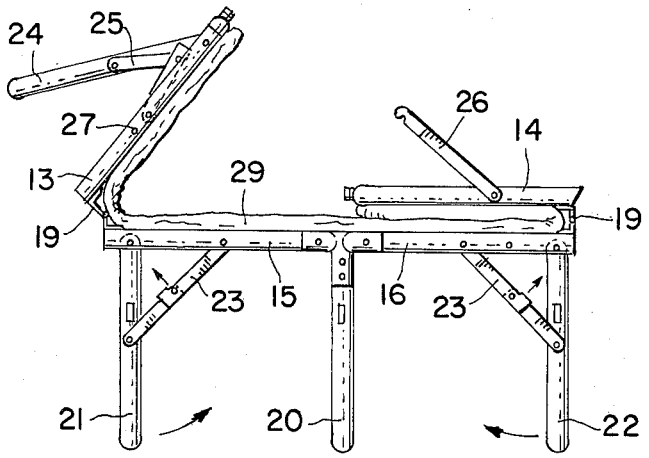
FIGS. 3–6 inclusive are views of the bed of FIGS. 1 and 2 in various stages of folding for transportation or storage.
Figure 4:
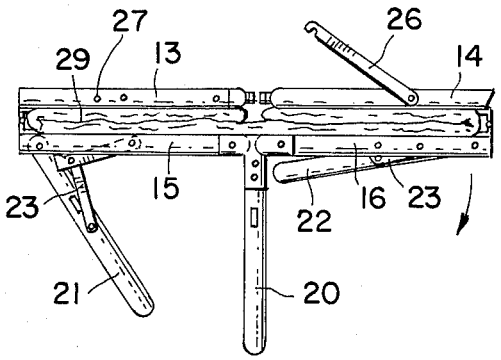
Figure 5:
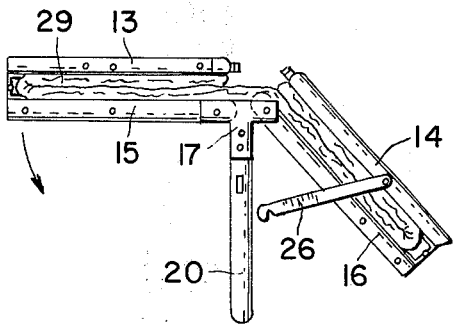
Figure 6:
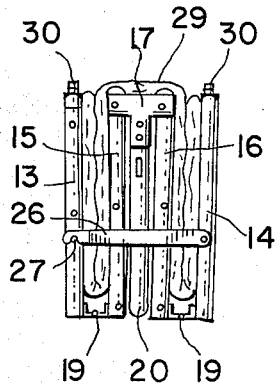

To fold the bed for transportation and storage, bar 26 is unlatched from pins 27 and end section 14 is folded about hinges 19 to lie against intermediate section 16. In the same manner end section 13 is folded about hinges 19 to lie against intermediate section 15. Both these steps are shown in FIG. 3 of the drawings. In the next step, braces 23 are bent about their pivotal centers to fold legs 21 and 22 upwardly against intermediate sections 15 and 16 as shown in FIG. 4 of the drawings. During this step, the whole bed assembly rests on leg 20. In the final step, as shown in FIG. 5, intermediate sections 15 and 16 are folded downwardly against leg 20 and pins 27 on section 13 are again engaged by latching bars 26 to hold the bed in completely folded position as shown in FIG. 6 of the drawings. Because of the shape of hinges 19, mattress 29 is accommodated between parallel sections 13, 15 and 14, 16. It will be noted that in the folded position handles 30 are located on the upper edges of the unit for convenience in carrying and handling the folded bed.

It will be appreciated that an additional leg could be pivotally attached to the outer extremity of end section 14 of frame 10 in the same manner as leg 24 on end section 13, to provide a flat-lying surface. Further, although the frame and legs of the bed are preferably formed from hollow round tubing it is within the contemplation of the invention to utilize tubing of other cross-sectional configurations or even flat or channel members.

By the structural arrangement of this invention, whereby the frame is subdivided into two central sections on a pair of outer sections, and whereby the two central sections are pivotable downwardly about a fixed leg whereas the two outer sections are pivotable upwardly with the leg of at least one of such outer sections being pivotable about the free end of the outer section a foldable bed has been provided which affords the desired rigidity in use and compactness and ready portability when not in use.

What I calim as new is:

1. A folding bed, comprising a substantially rectangular frame adapted to carry body supporting means in the plane thereof and articulated longitudinally into two central sections and two end sections; a central U-shaped leg having the upper free ends thereof secured to the vertical stems of a pair of T-shaped brackets, the two central sections of the frame being pivotally attached to the lateral arms of said T-shaped bracket so as to be foldable downwardly to lie against said central leg; the two end sections of the frame being pivotally attached to their adjacent central sections and foldable upwardly to lie against said central sections; longitudinally spaced legs pivotally attached to each central section remote from and on the opposed longitudinal sides of said central leg and foldable upwardly to lie against said central sections; a further leg pivotally attached to one of the end sections remote from the leg of the adjacent central section and foldable upwardly to lie against said end section; and means for releasingly securing the other of the end sections in a plane inclined to the plane of the frame.

2. A folding bed according to claim 1, including gripping means fixed to at least one end of the frame for carrying the bed.

3. A folding bed according to claim 1, wherein said releasable securing means is adapted to releasably lock the bed in its fully folded position.

4. A folding bed according to claim 3, wherein the releasable securing means comprises a latch pivotally mounted at one end on said other end section and engagable with a pin projecting from the opposed end section.

5. A folding bed according to claim 1, wherein the end sections of the frame are connected to the adjacent central sections by U-shaped springs to accommodate a mattress where the bed is in its fully folded position.

6. A folding bed according to claim 1, including a jackknife brace connecting each pivotally mounted leg and the section of the frame on which that leg is mounted, whereby the leg is releasably locked in its downward position away from the section.

7. A folding bed according to claim 1, wherein the frame includes parallel side bars which are L-shaped in cross-section and are thus adapted to receive the pivotally mounted legs when folded upwardly against the frame sections.

* * * * *